United States Patent [19]

Horner et al.

[11] Patent Number: 4,528,652

[45] Date of Patent: Jul. 9, 1985

[54] ULTRASONIC TRANSDUCER AND ATTENUATING MATERIAL FOR USE THEREIN

[75] Inventors: Michael S. Horner, Davis; Axel F. Brisken, Shingle Springs; Claudio I. Zanelli, Fair Oaks, all of Calif.

[73] Assignee: General Electric Company, Milwaukee, Wis.

[21] Appl. No.: 335,635

[22] Filed: Dec. 30, 1981

[51] Int. Cl.[3] ..... H04R 17/00

[52] U.S. Cl. ..... 367/162; 310/327; 367/176

[58] Field of Search ..... 367/162, 174, 176, 154, 367/155; 310/326, 327

[56] References Cited

U.S. PATENT DOCUMENTS

| | | | |
|---|---|---|---|
| 2,881,336 | 4/1959 | Elion | 310/327 |
| 2,972,068 | 2/1961 | Howry et al. | 367/162 |
| 3,515,910 | 6/1970 | Fritz et al. | 367/162 |
| 3,546,012 | 12/1970 | Dixon et al. | 310/327 |
| 3,794,866 | 2/1974 | McElroy et al. | 310/327 |

OTHER PUBLICATIONS

Beerman, "Optimizing Matching Layers for a Three--Section Broad-Band Piezoelectric PZT-5A Transducer Operating into a Wafer", IEEE Transactions on Sonics and Ultrasonics, vol. SU-28, No. 1, Jan. 1981, p. 53.

*Primary Examiner*—S. A. Cangialosi
*Assistant Examiner*—Gregory Issing
*Attorney, Agent, or Firm*—Flehr, Hohbach, Test, Albritton & Herbert

[57] ABSTRACT

An improved material for an ultrasonic transducer assembly having improved noise suppression characteristics comprising an ultrasonic transducer having a plurality of surfaces, a housing for receiving said transducer whereby one surface of said transducer is free to transmit and receive ultrasonic waves, and a material positioned about said transducer and between said transducer and the environment or housing for attenuating ultrasonic energy, said material comprising a heavily loaded resin based on an unfilled low viscosity potting gel and a filler selected from the group consisting of heavy oxides, metal powders, and density lowering fillers. In specific embodiments lead oxide, tungsten powder, and glass microspheres have been used as the filler in a silicone or flexible epoxy.

5 Claims, 5 Drawing Figures

ULTRASONIC TRANSDUCER AND ATTENUATING MATERIAL FOR USE THEREIN

This invention relates generally to ultrasonic transducers, and more particularly the invention relates to improved ultrasonic attenuating material for use in ultrasonic transducers and the like.

Ultrasonic scanning apparatus such as used for medical diagnostic purposes utilize sound transducers to transmit ultrasonic waves (e.g. on the order of several megahertz) into a patient and to receive echo signals. The echo signals are converted to electrical signals by the transducer, and the electrical signals are electronically processed and used to control display apparatus for depicting the internal structure of a patient.

Artifacts in the display due to noise and extraneous signals can degrade the image. Particularly, ultrasonic echoes reflecting from physical members within the transducer housing and reverberations can degrade the diagnostic utility of the system. Since the pulsed transducer elements radiate ultrasonic energy from all surfaces, sonic energy attenuating backing material must be provided about the transducer elements to limit wave propagation from and reception by a single "radiative" surface of the transducer. It is especially important that backing materials attenuate ultrasonic energy in dimensions small compared to the geometric structures of the device. It is also important that backing materials have low acoustic impedances when compared to transducer material impedance so as to not reduce transducer overall sensitivity.

Heretofore, backing materials have proved to be deficient. Adhesively bonded or compression molded rubbers such as neoprene and gum rubber limit the design geometry of a transducer assembly by eliminating the ability to encapsulate wire leads, components, and other fragile structures. Filled hard epoxy systems such as Epotek 301 or Techform EA-700 are relatively poor ultrasonic wave attenuators. Commercially available silicone rubber formulations offer only moderate acoustic impedance and ultrasonic wave attenuation.

Accordingly, an object of the present invention is an improved ultrasonic transducer assembly.

Another object of the invention is an improved attenuating material for use with ultrasonic transducers and the like.

A feature of the invention is a heavily loaded resin based on an unfilled, low viscosity silicone rubber or epoxy gel with a filler selected from heavy oxides, metal powders, and density lowering fillers such as glass microballoons.

The invention and objects and features thereof will be more readily apparent from the following detailed description and appended claims when taken with the drawing, in which:

Figure 1A:
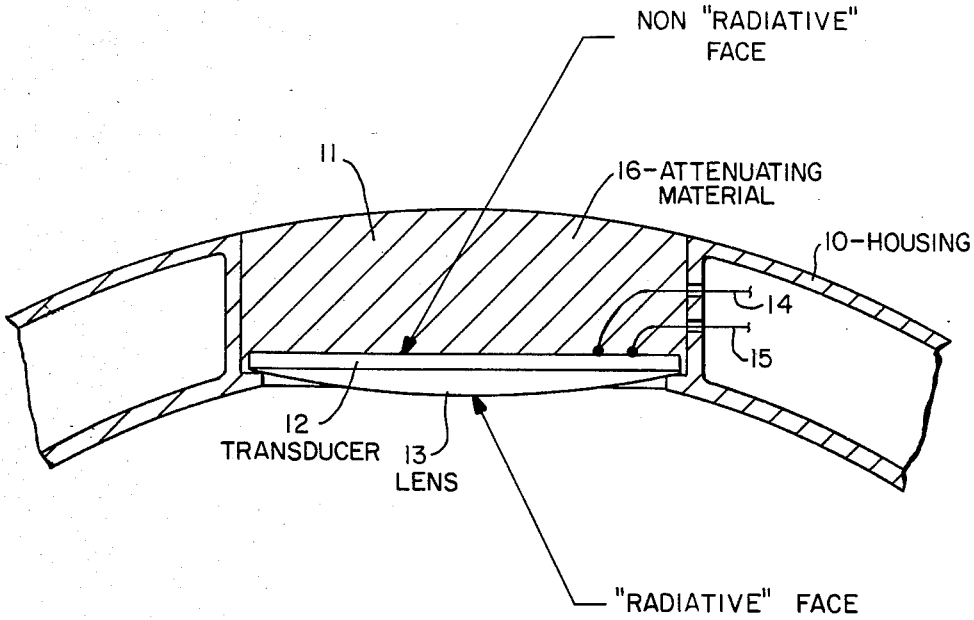
FIGS. 1A and 1B are cross sectional views of a single element transducer and array transducer, respectively, in accordance with the invention.
Figure 1B:
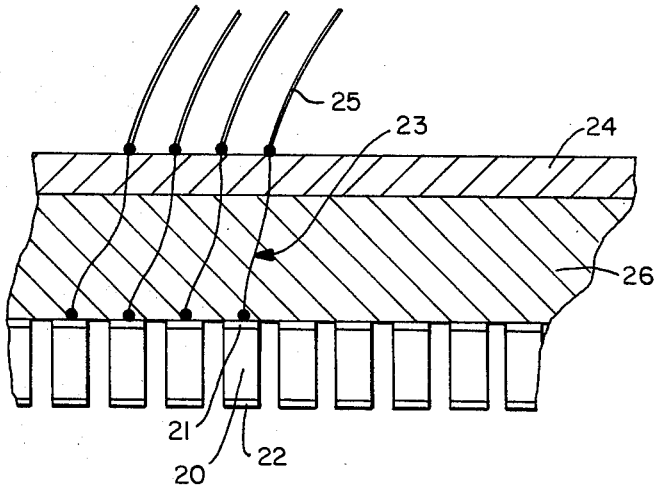

Referring now to the drawings, FIGS. 1A and 1B are cross sectional views of a single element and array transducer, respectively. The single element assembly of FIG. 1A includes a housing 10 having a recessed portion 11 which receives a transducer element 12 and its focusing lens 13. Signal lead 14 and ground lead 15 pass through the housing wall into the recessed portion 11 and are connected to the transducer element 12. The attenuating backfill material 16 is shown as a casting over the back side of the transducer element 12, encapsulating signal 14 and ground lead wires 15.

The array assembly of FIG. 1B includes a multiplicity of independent transducer elements 20 with signal electrode 21 and ground electrode 22 on opposite faces. Due to the small physical size of the individual elements 20, the signal lead wire 23 is extremely thin (typically 0.001 inches diameter) and fragile. The wire leads 23 pass up to a structural member 24 for connection to external wiring 25. The attenuating backfill material 26 is poured over the back of the elements 20 and around the thin lead wires 23.

Figure 2A:
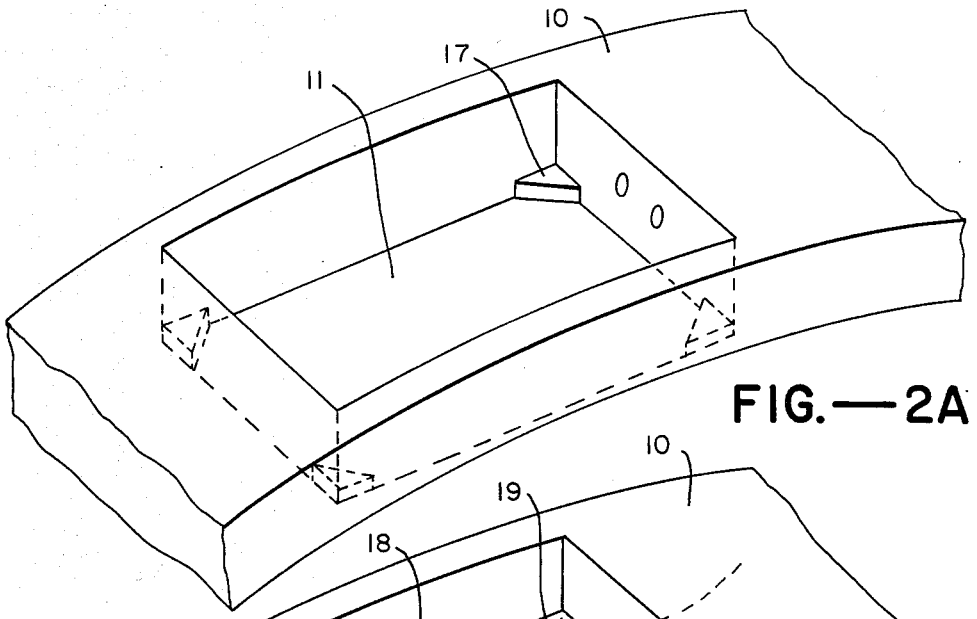
FIGS. 2A–2C are perspective views of the single element transducer assembly of FIG. 1 which illustrate fabrication of the assembly.
Figure 2B:
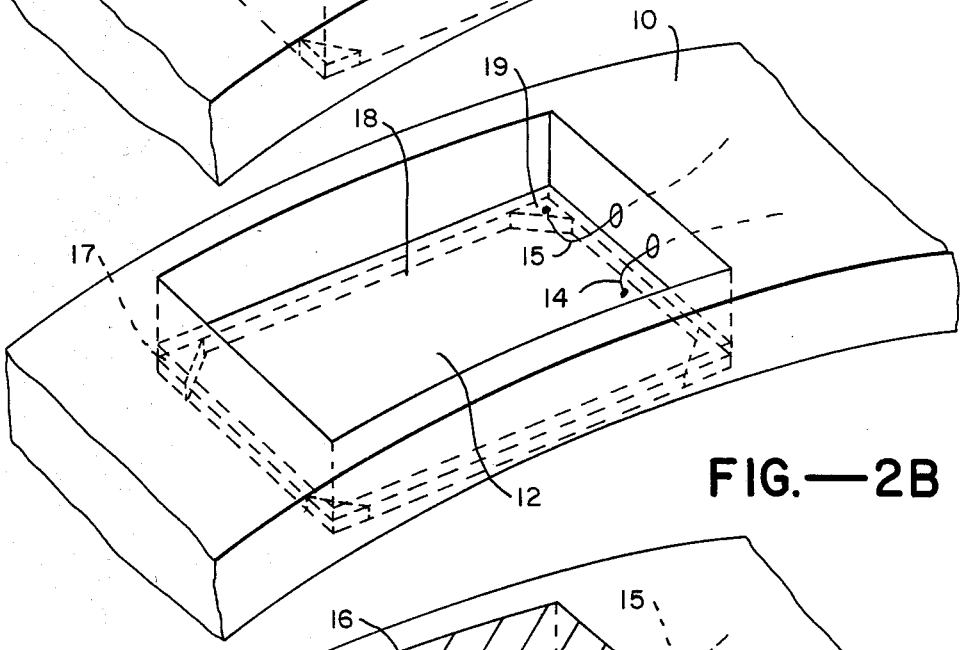
Figure 2C:
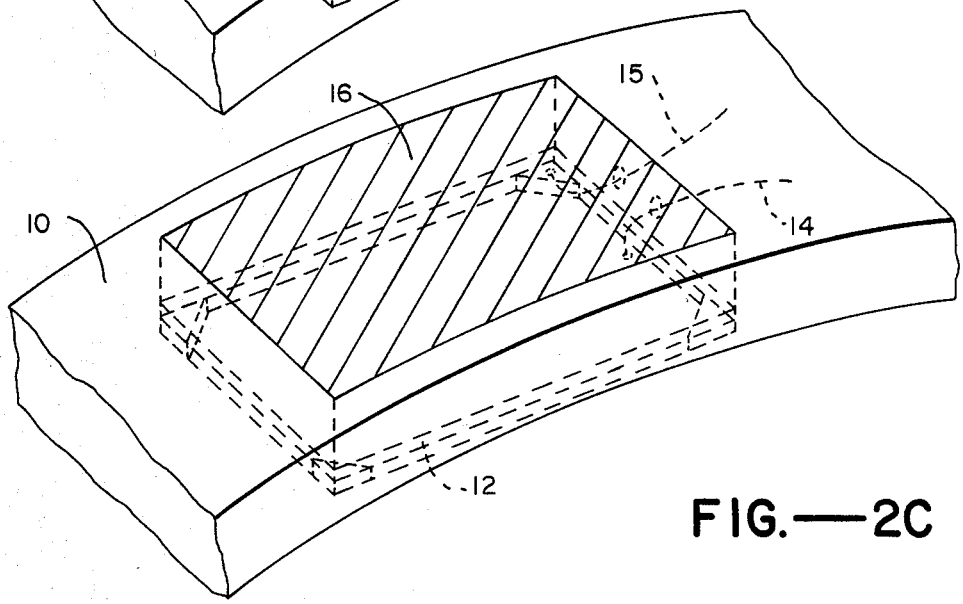

FIGS. 2A, 2B and 2C illustrate the fabrication of the single element transducer assembly. In FIG. 2A, the housing 10 and recessed area 11 are shown prior to the positioning of the transducer element 12 therein, against the corner holding tabs 17. FIG. 2B depicts the transducer element 12 mounted in the recessed cavity 11, with the back, "non-radiative" side of the element 12 in view. The back side of the element 12 may contain regions defined as the signal electrode 18 and regions defined as the ground electrode 19. Following mounting and securing of the element 12 in the frame 10, the signal lead 14 and ground lead 15 are attached to the transducer element signal electrode 18 and ground electrode 19, respectively. Lastly, as sketched in FIG. 2C, the attenuating backfill material 16 is cast over the assembled transducer element. Casting the backing material 16 directly onto the transducer element 12 causes them to come into intimate contact.

In an ultrasonic scanning operation the transducer is normally energized to transmit ultrasonic signals having a frequency on the order of a few megahertz, and reflected signals of much smaller amplitude are received by the trans ducer and converted to electrical signals. As above described, the pulsed transducer elements radiate ultrasonic energy from all surfaces, and low impedance acoustic absorbing material must be provided as backing between the transducer and the environment. Materials having ultrasonic attenuation of 0–7 decibel per megahertz per centimeter (dB/Mhz/cm) are considered poor absorbers, and materials having attenuation of 8–30 dB/Mhz/cm are considered only moderate absorbers. Backing materials having attenuation of 30–60 dB/Mhz/cm are considered good absorbers, and any material having an attenuation greater than 60 dB/Mhz/cm is considered exceptional.

Heretofore backing materials for use in ultrasonic transducers have offered moderately low attenuation. For example, filled hard epoxy systems typically have an attenuation of 5–12 dB/Mhz/cm and are characterized by unacceptably high acoustic impedances. Off-the-shelf silicone rubber formulations have low acoustic impedances of typically $1.1–2.2\times10^6$ rayls and moderately low attenuation of 10–40 dB/Mhz/cm. Known attempts at using silicone rubber with heavy oxide fillers have been only moderately successful. For example, General Electric (GE) RTV-11 silicone has been loaded with lead oxide in a mixture of 1 part silicone to 0.7 parts of lead oxide for use in acoustic structures. This mixture offered an acoustic attenuation of 44 dB/Mhz/cm, but was limited by high viscosity and little versatility in fabrication. Adhesively bonded or compressed molded rubber such as neopreme and gum rubber limit design geometry by eliminating the ability to encapsulate wire leads, components, and other fragile structures.

In accordance with the invention, groups of mixtures have been discovered to offer very good to exceptional attenuation characteristics for use as backing materials in transducer assemblies. These groups of materials have included such GE silicone rubbers as RTV-11, RTV-28, and RTV-602 and Emerson and Cumings (EC) silicone rubber such as Eccosil 2CN which are loaded with dense materials such as lead oxide, metal powders such as tungsten, and/or density lowering fillers such as EC microspheres. Additionally, low viscosity flexible epoxys and epoxy gels such as EC Eccogel 1265, Eccogel 1365-0, and Eccogel 1365-90 can be used in place of the silicone rubbers. After thoroughly mixing the ingredients and insuring that any filler material lumps have been broken up, the mixture is degassed in a suitable vacuum chamber.

The following is a list of mixtures which have proved to offer good to exceptional attenuation. Values quoted for acoustic impedance and attenuation are measured values and represent typical results from several test castings.

| Material Mixture | Mix Ratio (By Weight) | Acoustic Impedance ($\times 10^6$ Rayls) | Acoustic Attenuation (dB/Mhz/cm) |
|---|---|---|---|
| EC-2CN:PbO | 1:1.5 | 2.1 | 88 |
| " | 1:3.0 | 2.2 | 105 |
| " | 1:4.5 | 2.6 | 78 |
| " | 1:6.0 | 3.3 | 64 |
| GE-RTV602:PbO | 1:1 | 1.6 | 41 |
| " | 1:2 | 1.9 | 65 |
| " | 1:3 | 2.3 | 60 |
| " | 1:4 | 2.4 | 40 |
| " | 1:5 | 2.5 | 37 |
| " | 1:6 | 2.8 | 45 |
| GE-RTV602:$Pb_3O_4$EC-Microspheres | 1:2.8:0.08 | 2.1 | 80 |
| GE-RTV602:$Qb_3O_4$EC-Microspheres | 1:3.2:0.36 | 2.3 | 94 |
| EC-Eccogel 1365-0:PbO | 1:2.24 | 4.2 | 34 |
| EC-Eccogel 1365-90:PbO | 1:2.0 | 4.6 | 16 |
| EC-Eccogel 1365-90:PbO | 1:3.1 | 5.3 | 18 |
| EC-Eccogel 1365-90:PbO: EC-Microspheres | | | |
| EC-Eccogel 1365-90:PbO: EC-Microspheres | 1:2.0:0.12 | 3.7 | 20 |
| EC-Eccogel 1365-90:PbO: EC-Microspheres | 1:2.0:0.23 | 3.1 | 20 |
| EC-Eccogel 1365-90:PbO: EC-Microspheres | 1:2.0:0.43 | 2.7 | 23 |

Improved ultrasonic transducer assemblies have been produced by using backing material in accordance with the present invention. While the invention has been described with reference to specific embodiments, the description is illustrative of the invention and is not to be construed as limiting the invention. Thus, those skilled in the art may make variations and adaptations of the embodiments without departing from the true spirit and scope of the invention as defined by the appended claims.

What is claimed is:

1. An ultrasonic transducer assembly having improved noise suppression characteristics comprising ultrasonic transducer means having a plurality of surfaces, a housing for receiving said transducer whereby one surface of said transducer is free to transmit and receive ultransonic waves, and a material positioned about said transducer and between said transducer and said housing for attenuating ultrasonic energy, said material comprising a heavily loaded resin based on an unfilled low viscosity silicone rubber potting gel and a particle filler wherein the particle filler is lead oxide (Pb0) in the ratio of 1:1.5 to 1:6.0 whereby the material acoustic impedance is in the range of 2.1 to $3.3\times 10^6$ rayls and the acoustic attenuation is in the range of 64 to 105 dB/MHz/cm.

2. An ultrasonic transducer assembly having improved noise suppression characteristics comprising ultrasonic transducer means having a plurality of surfaces, a housing for receiving said transducer whereby one surface of said transducer is free to transmit and receive ultrasonic waves, and a material positioned about said transducer and between said transducer and said housing for attenuating ultrasonic energy, said material comprising a heavily loaded resin based on an unfilled low viscosity silicone rubber potting gel and a particle filler wherein the particle filler is lead oxide (Pb0) in the ratio of 1:1 to 1:6 whereby the material acoustic impedance is in the range of 1.6 to $2.8\times 10^6$ rayls and the acoustic attenuation is in the range of 37 to 65 dB/MHz/cm.

3. An ultrasonic transducer assembly having improved noise suppression characteristics comprising ultrasonic transducer means having a plurality of surfaces, a housing for receiving said transducer whereby one surface of said transducer is free to transmit and receive ultrasonic waves, and a material positioned about said transducer and between said transducer and said housing for attenuating ultrasonic energy, said material comprising a heavily loaded resin based on an unfilled low viscosity silicone rubber potting gel and a particle filler wherein the particle filler is lead oxide ($Pb_30_4$) and glass microspheres in the ratio of 1:2.8:0.08 to 1:3.2:0.36 whereby the material acoustic impedance is in the range of 2.1 to $2.3\times 10^6$ rayls and the acoustic attenuation is in the range of 80 to 94 dB/MHz/cm.

4. An ultrasonic transducer assembly having improved noise suppression characteristics comprising ultrasonic means having a plurality of surfaces, a housing for receiving said transducer whereby one surface of said transducer is free to transmit and receive ultrasonic waves, and a material positioned about said transducer and between said transducer and said housing for attenuating ultrasonic energy, said material comprising a heavily loaded resin based on an unfilled low viscosity silicone rubber potting gel and a particle filler wherein the particle filler is selected from the group consisting of tungsten oxide and tungsten powder in the ratio of 1:1.5 to 1:6.0 whereby the material acoustic impedance is in the range of 2.1 to $3.3\times 10^6$ rayls and the acoustic attenuation is in the range of 64 to 105 dB/MHz/cm.

5. An ultrasonic transducer assembly having improved noise suppression characteristics comprising ultrasonic transducer means having a plurality of surfaces, a housing for receiving said transducer whereby one surface of said transducer is free to transmit and receive ultrasonic waves, and a material positioned about said transducer and said housing for attenuating ultrasonic energy, said material comprising a heavily loaded resin based on an unfilled low viscosity silicone rubber potting gel and a particle filler wherein the particle filler is selected from the group consisting of tungsten oxide and tungsten powder in the ratio of 1:1 to 1:6 whereby the material acoustic impedance is in the range of 1.6 to $2.8\times 10^6$ rayls and the acoustic attenuation is in the range of 37 to 65 dB/$MH_2$/cm.

* * * * *